US007086190B2

(12) United States Patent
Voluckas

(10) Patent No.: US 7,086,190 B2
(45) Date of Patent: Aug. 8, 2006

(54) DISPLAY SYSTEM FOR SUSPENDING VISUALS FOR EXHIBIT, TRAINING OR ADVERTISING

(76) Inventor: Stanley A. Voluckas, P.O. Box 2447, Hyannis, MA (US) 02601

( * ) Notice: Subject to any disclaimer, the term of this patent is extended or adjusted under 35 U.S.C. 154(b) by 103 days.

(21) Appl. No.: 10/765,114

(22) Filed: Jan. 28, 2004

(65) Prior Publication Data

US 2005/0160648 A1 Jul. 28, 2005

(51) Int. Cl.
*G09F 7/22* (2006.01)

(52) U.S. Cl. ..... 40/617; 40/604; 248/331

(58) Field of Classification Search ..... 40/601, 40/617, 604; D6/301; 446/227; 24/115 G; 248/331, 343

See application file for complete search history.

(56) References Cited

U.S. PATENT DOCUMENTS

| | | | | |
|---|---|---|---|---|
| 662,089 | A | 11/1900 | Pettey | |
| 3,683,527 | A | 8/1972 | Gilman | |
| 3,850,401 | A | 11/1974 | Snediker | |
| 4,392,316 | A | 7/1983 | Thomas | 40/617 |
| 4,434,570 | A | 3/1984 | Roos | 40/617 |
| 4,567,682 | A * | 2/1986 | Hurxthal | 40/617 |
| 4,729,182 | A * | 3/1988 | Sherman | 40/124 |
| 4,829,688 | A | 5/1989 | Mouraret et al. | 40/622 |
| 5,471,774 | A | 12/1995 | Hoyt et al. | 40/601 |
| 5,529,274 | A | 6/1996 | Anderson et al. | |
| 5,667,855 | A | 9/1997 | Borden et al. | |
| 5,697,128 | A * | 12/1997 | Peregrine | 24/115 G |
| 5,718,402 | A | 2/1998 | Hoffman et al. | |
| 5,870,845 | A | 2/1999 | Ruderman et al. | 40/601 |
| 6,192,611 | B1 | 2/2001 | Molla | 40/604 |
| 6,240,681 | B1 * | 6/2001 | Lyles et al. | 52/39 |
| 6,327,803 | B1 | 12/2001 | Ruderman | 40/601 |
| 6,332,284 | B1 | 12/2001 | Tafforeau | 40/603 |
| 6,467,742 | B1 | 10/2002 | Pitcher | |
| 2002/0121034 | A1 | 9/2002 | Schmitt | 40/610 |
| 2002/0170217 | A1 | 11/2002 | Nelson | 40/604 |
| 2002/0189144 | A1 | 12/2002 | Huggard | |

* cited by examiner

*Primary Examiner*—Joanne Silbermann
(74) *Attorney, Agent, or Firm*—Richard C. Litman

(57) ABSTRACT

A display system for suspending visuals for exhibit, training or advertising made up of an assembly of commercially available items, and used to display a banner or sign in a manner that is particularly useful on the set of a local television station. One embodiment has elastic cords, slotted tubular members, floor anchors, cord hooks, cord locks and a ceiling interface. When a rigid sign is situated with its bottom edge positioned in the lower tubular member slot and its top edge in the upper tubular member slot, the sign is suspended for viewing. In another embodiment, horizontal rods are supported by two tubular members with portions of the rods extended beyond the ends the tubular members. Several banner clips are used to clip a banner to the portions of the rods extending beyond the ends of the tubular members to suspend the banner for viewing. Other embodiments incorporate more than one set of either slotted tubular members or rod-supporting tubular members, or a combination of slotted tubular members and rod-supporting tubular members.

13 Claims, 13 Drawing Sheets

DISPLAY SYSTEM FOR SUSPENDING VISUALS FOR EXHIBIT, TRAINING OR ADVERTISING

BACKGROUND OF THE INVENTION

1. Field of the Invention

The present invention relates to the display of signs and banners, and more particularly, to a system for displaying signs and banners that uses a combination of commercially available items to quickly and easily suspend a sign or banner from a ceiling or lighting grid in such a manner that allows for easy adjustment of the height and angle of the displayed article. The invention is particularly useful on the sets of local television stations.

2. Description of the Related Art

Prior art devices for displaying signs and banners have several known drawbacks and, in general, are not useful on the set of a local television station. Known drawbacks of these devices include the inability to adjust the height or the angle of the displayed article, the complexity of installing and removing the display, lack of portability, and the likelihood of tipping over.

To be useful on a television set, a display device must be portable, easily installed and removed, and able to accommodate multiply display articles at one time as well as accommodate both banners and rigid signs at the same time. Additionally, the device must allow for adjustment of the height and angle of the displayed banner or sign. Because adjustments of the height and angle of displayed articles are required to minimize the reflection of studio lighting into the camera, this feature is particularly important on a television set.

U.S. Pat. No. 662,089 issued Nov. 20, 1900 to J. A. Pettey (display device); U.S. Pat. No. 3,683,527 issued Aug. 15, 1972 to M. G. Gilman (pole display); U.S. Pat. No. 3,850,401 issued Nov. 26, 1974 to R. R. Snediker (pivotal support device); U.S. Pat. No. 4,434,570 issued Mar. 6, 1984 to J. Roos (advertising holder); U.S. Pat. No. 4,829,688 issued May 16, 1989 to G. Mouraret et al. (display panel); U.S. Pat. No. 5,471,774 issued Dec. 5, 1995 to W. S. Hoyt et al. (message sign); U.S. Pat. No. 5,529,274 issued Jun. 25, 1996 to C. S. Anderson et al. (sign suspension system); U.S. Pat. No. 5,870,845 issued Feb. 16, 1999 to L. Ruderman et al. (banner display system); U.S. Pat. No. 6,192,611 issued Feb. 27, 2001 to P. Molla (banner support assembly); and U.S. Pat. No. 6,327,803 issued Dec. 11, 2001 to L. Ruderman (banner display system) provide examples of prior art display devices that are neither portable nor easy use.

U.S. patent application Pub. No. 2002/0170217 published Nov. 21, 2002 on behalf of N. H. Nelson (banner holder); U.S. patent application Pub. No. 2002/0189144 published on Dec. 19, 2002 on behalf of W. L. Huggard, Jr. (banner display system); U.S. Pat. No. 4,392,316 issued Jul. 12, 1983 to P. D. Thomas (ceiling suspended product display); U.S. Pat. No. 5,667,855 issued Sep. 16, 1997 to T. W. Borden et al. (reusable tear through banner); U.S. Pat. No. 5,718,402 issued Feb. 17, 1998 to M. S. Hoffman et al. (poster gripping extrusion); and U.S. Pat. No. 6,467,742 issued Oct. 22, 2002 to D. E. Pitcher (poster gripping extrusion) provide examples of prior art display devices that lack versatility of use. Most of these devices are limited to use with only one type of display article, i.e., a either a sign or a banner.

U.S. patent application Pub. No. 2002/0121034 published Sep. 5, 2002 on behalf of A. J. Schmitt (banner display stand) and U.S. Pat. No. 6,332,284 issued Dec. 25, 2001 to J. L. Tafforeau (panel display with stretchable structure) provide examples of display devices prone to tipping over.

Accordingly, none of the above inventions and patents is seen to describe the instant invention as claimed and, therefore, a system for displaying signs and banners solving the aforementioned problems is desired.

SUMMARY OF THE INVENTION

The display system for, suspending visuals for exhibit, training or advertising is an assembly of commercially available items used to display a banner or sign in a manner that is particularly useful on the set of a local television station. One embodiment of the device includes two elastic cords, two slotted tubular members, two floor anchors, four cord hooks, two cord locks and a ceiling interface. Each cord is attached to the ceiling at one end and to one of the anchors at the other end. Each slotted tubular member has two holes that are used to suspend the tubular members on the cords. Each cord passes through one of the holes in each tubular member. The lower tubular member is held in place by the two cord locks with its slot facing upward and the upper tubular member is oriented with its slot facing downward. When a rigid sign is situated with its bottom edge positioned in the lower tubular member slot and its top edge in the upper tubular member slot, the sign is suspended for viewing.

In another embodiment, a horizontal rod is supported by each of the two tubular members with portions of the rods extending beyond the ends of each of the tubular members. Several banner clips are used to clip a banner to the portions of the rods extending beyond the ends of the tubular members, thereby suspending the banner for viewing.

Other embodiments incorporate more than one set of either slotted tubular members or rod-supporting tubular members, or a combination of slotted tubular members and rod-supporting tubular members.

Accordingly, it is a principal object of the invention to provide a means for displaying signs and banners that is portable, easily stored, and easily installed and removed.

It is another object of the invention to provide a means for displaying signs and banners that enables adjustment of the height and angle of the displayed sign or banner. This feature is of particular importance in local television station applications where adjustments of height and angle are required to minimize the reflection of studio lighting into the camera.

It is a further object of the invention to provide a means for displaying signs and banners that is assembled from a combination of inexpensive commercially available components.

Still another object of the invention is to provide a means for displaying signs and banners capable of displaying both banners and signs mounted on foam board.

Yet another object of the invention is to provide a means for displaying signs and banners capable of suspending signs and banners from either a ceiling or a lighting grid in such a manner that minimizes the possibility of the display falling over.

A further object of the invention is to provide a means for displaying signs and banners that is particularly useful on the set of a local television station.

Moreover, it is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a display system for suspending visuals for exhibit, training or advertising that is assembled from a combination of commercially available items and that can be arranged in a variety of configurations to meet the varying needs of a local television studio set.

Figure 2:
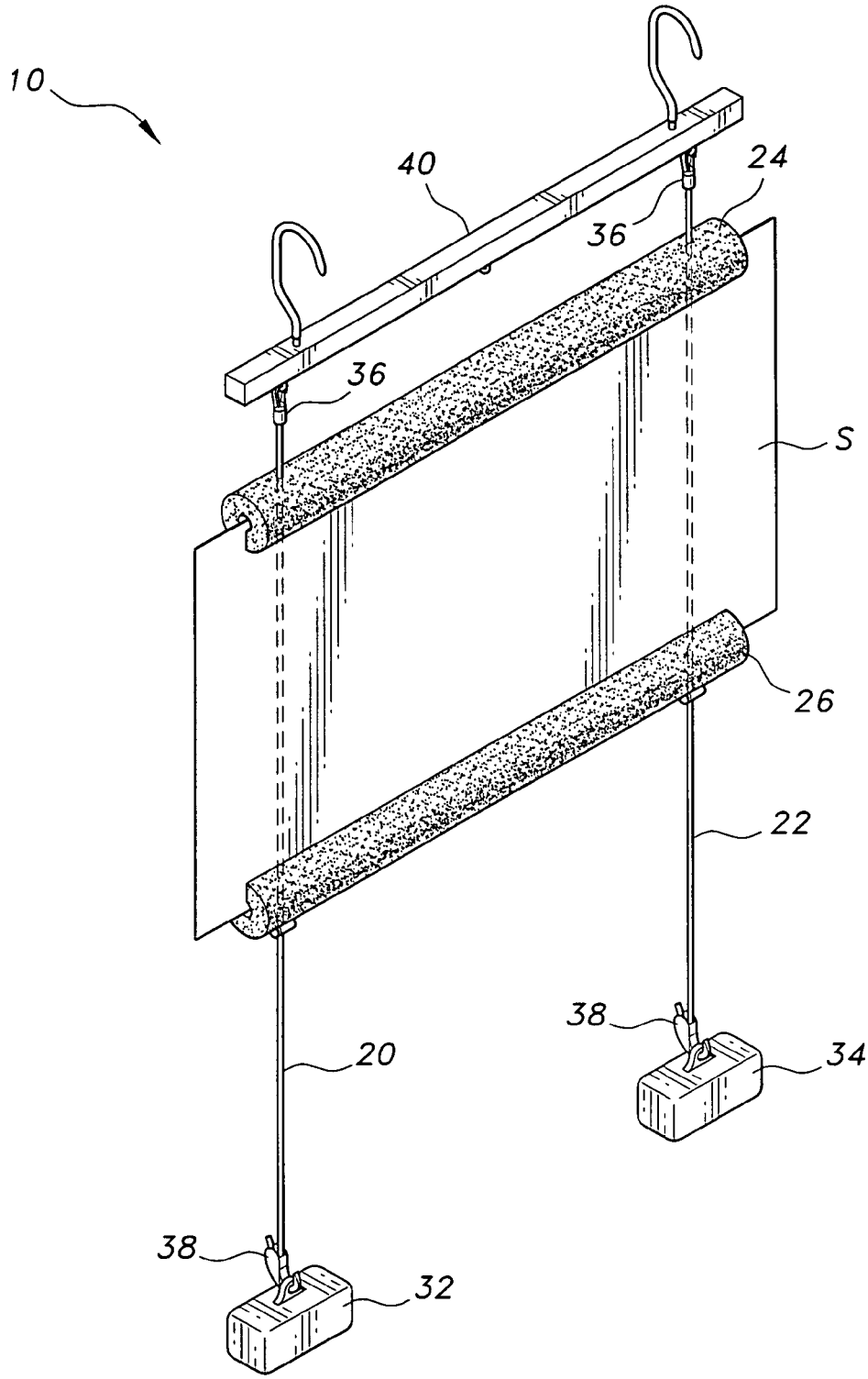
FIG. 2 is a perspective view of a display system for suspending visuals for exhibit, training or advertising according to the present invention shown displaying a sign mounted on foam board.
Figure 3:
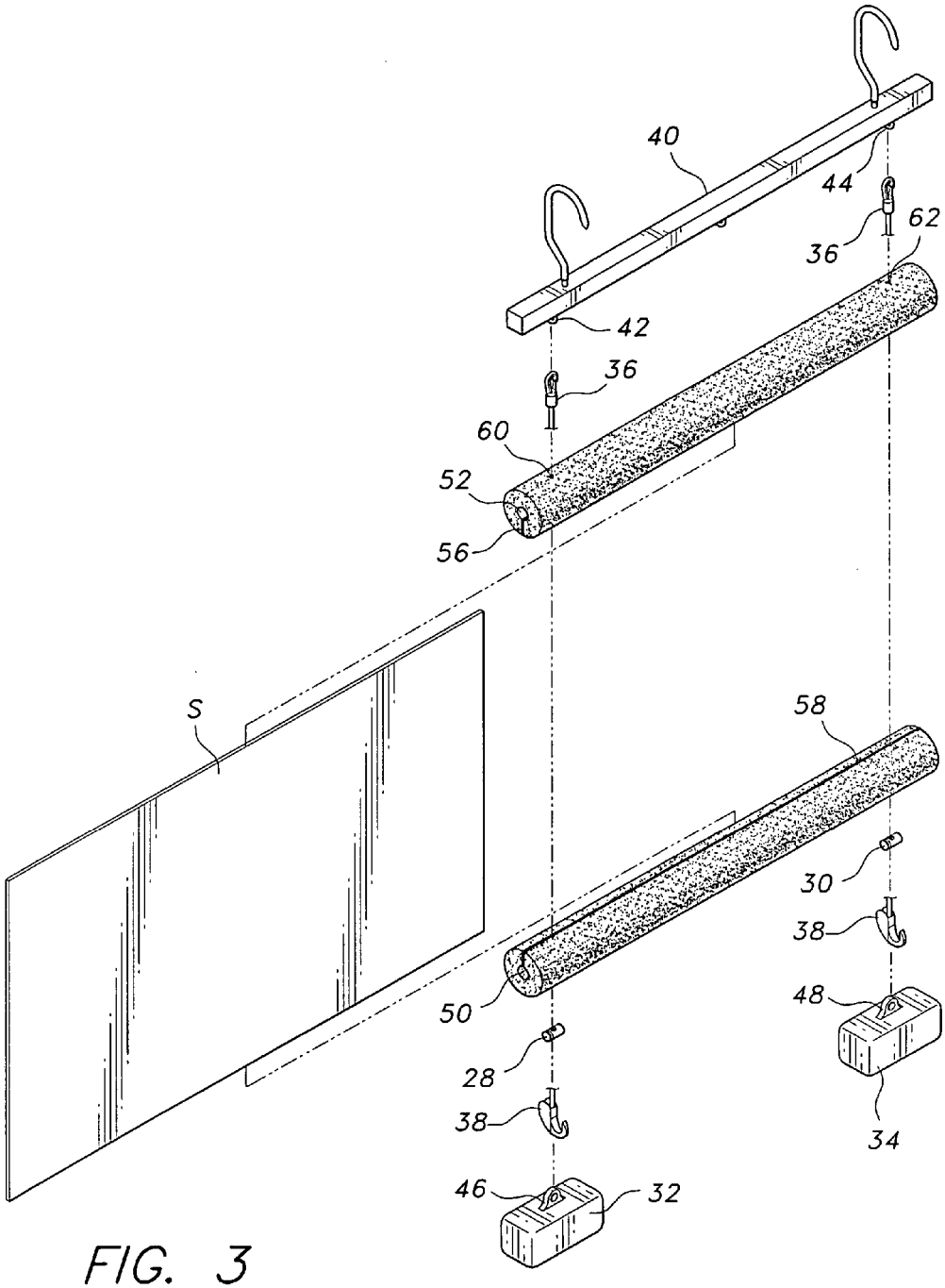
FIG. 3 is an exploded view of the foam board mounted sign shown in FIG. 2.

FIGS. 2 and 3 illustrate one embodiment of the invention, designated generally as 10, that is configured to display a rigid sign. This embodiment 10 includes two elastic cords 20 and 22, two slotted tubular members 24 and 26, two cord lock members 28 and 30, two floor anchor members 32 and 34, four cord hook members 36 and 38, and a ceiling interface member 40.

Figure 9A:
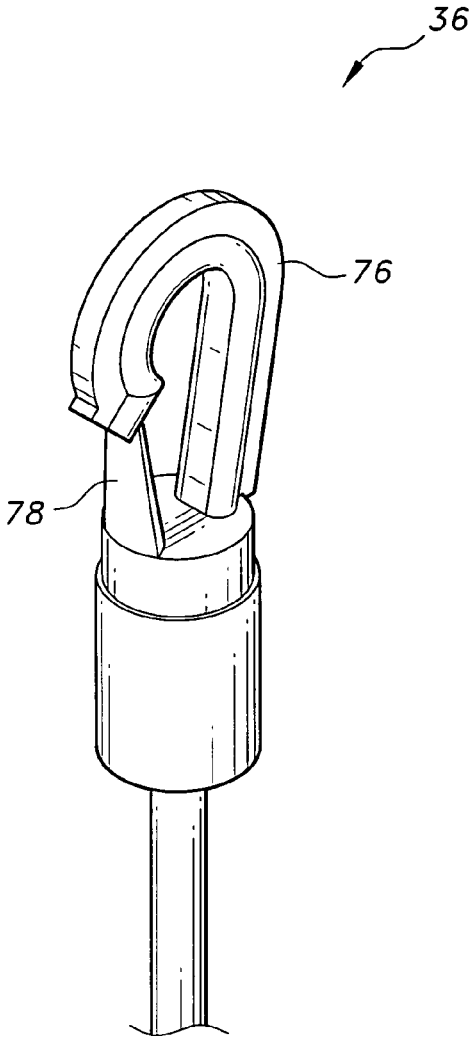
FIGS. 9A—9D are perspective views of four embodiments of a cord hook member for a display system for suspending visuals for exhibit, training or advertising according to the present invention.

The upper end of each of the cords 20 and 22 is fitted with a cord hook member 36 (shown separately in FIG. 9A) that is hooked to one of two loops 42 and 44 extending downward from the ceiling interface member 40. The lower end of each cord 20 and 22 is fitted with a cord hook member 38 (shown separately in FIG. 9D) that is hooked to a loop 46 and 48 extending upward from a floor anchor member 32 and 34. The cords 20 and 22 are taut between the ceiling interface member 40 and the two floor anchor members 32 and 34.

Figure 11A:
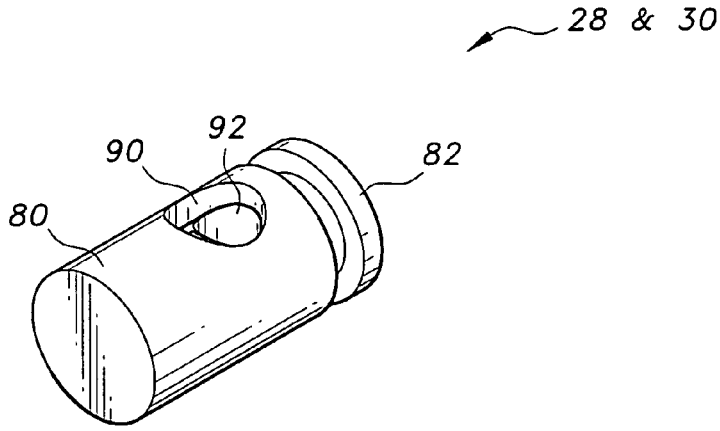
FIG. 11A is a perspective view of a cord lock member for a display system for suspending visuals for exhibit, training or advertising according to the present invention.
Figure 11B:
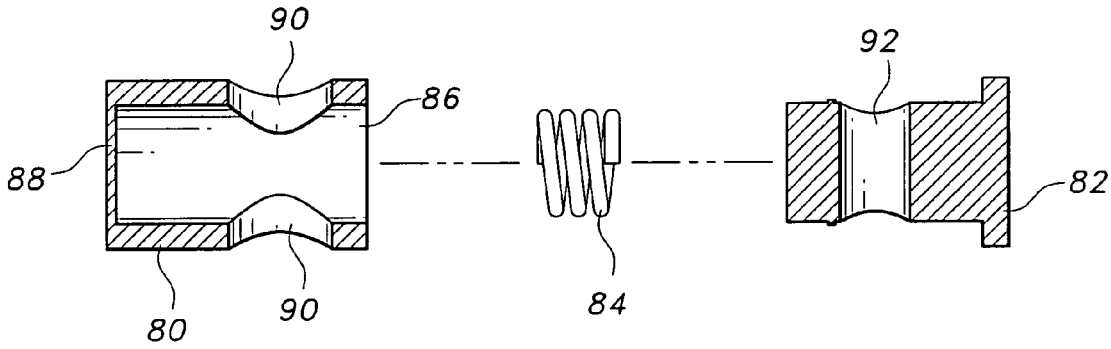
FIG. 11B is an exploded view of the cord lock shown in FIG. 11A.

As shown in FIGS. 11A and 11B, each of the cord locks 28 and 30 includes a cylindrical outer shell 80 with an open end 86 and a closed end 88, a cylindrical inner shell 82 with two closed ends fitted partially inside the outer shell 80, and a spring 84 positioned inside the outer shell 80 between the closed end 88 of the outer shell 80 and an end of the inner shell 82. An aperture 90 and 92 passes completely through each of the inner and outer shells 80 and 82. For each cord lock 28 and 30, the apertures 90 and 92 in the inner and outer shells 80 and 82 align when the inner shell 82 is pressed into the outer shell 80 and thereby allow for movement of a cord 20 and 22 through the cord lock member 28 and 30. When the inner shell 82 is released, the apertures 90 and 92 move out of alignment thereby pinching the cord lock member 28 and 30 onto a cord 20 and 22. Each cord lock 28 and 30 is positioned substantially the same distance from the floor on its own cord 20 and 22.

Each of the slotted tubular members 24 and 26 is substantially cylindrical in shape with a coaxial cylindrical cavity 50 and 52 and an open slot 56 and 58 extending from the cavity 50 and 52 to the outer surface of the member. Each slotted tubular member 24 and 26 also has two apertures 60 and 62 extending from its cavity 50 and 52 to its outer surface with the apertures 60 and 62 opposite the open slot 56 and 58.

The tubular members 24 and 26 are suspended on the cords 20 and 22 with each cord 20 and 22 passing through the slot 56 and 58 and one of the apertures 60 and 62 of each of the tubular members 24 and 26. The upper tubular member 24 is suspended on the cords 20 and 22 above the lower tubular member 26 and is oriented with its apertures 60 and 62 above its slot 56. The lower tubular member 26 is oriented with its apertures under its slot 58 and rests on top of the cord lock members 28 and 30 thereby being held in position on the cords 20 and 22 by the cord lock members 28 and 30. The bottom edge of a sign S is positioned in the lower tubular member slot 58 with the sign S being supported by the lower tubular member 26. The top edge of the sign S is positioned in the slot 56 of the upper tubular member 24 such that the upper tubular member 24 is supported by the sign S while holding the sign S in place.

Figure 10A:
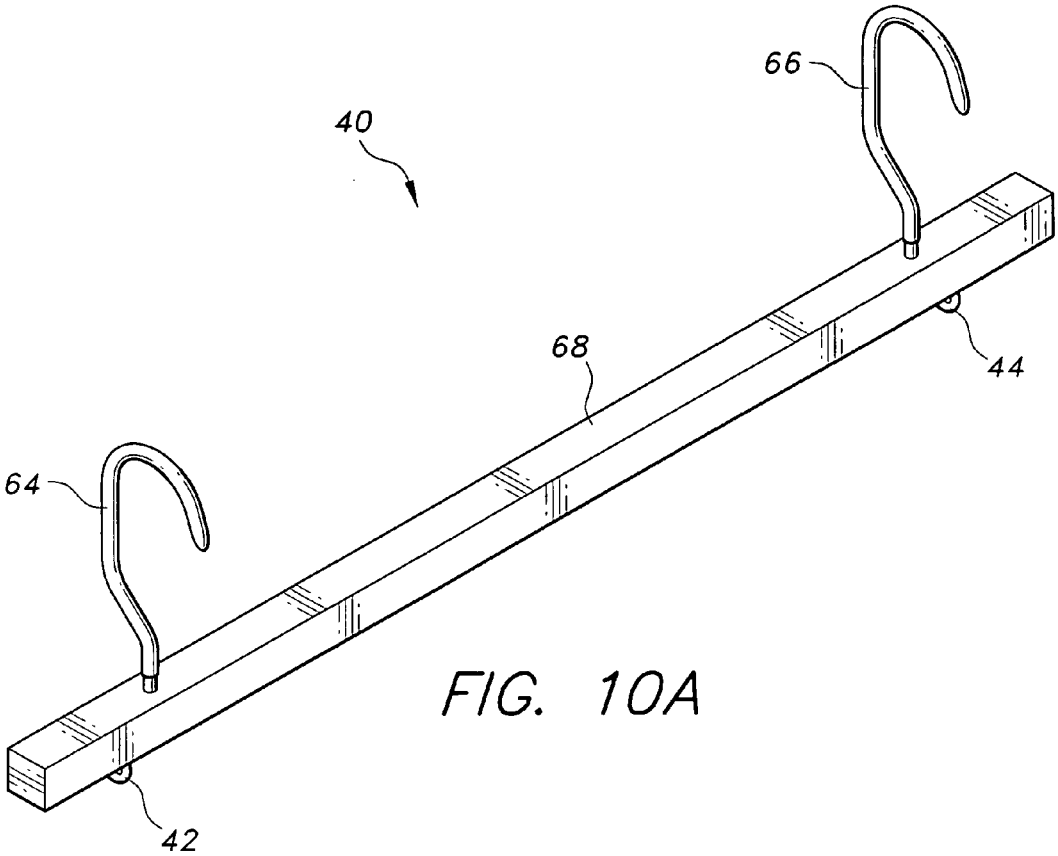
FIGS. 10A—10C are perspective views of three embodiments of a ceiling interface member for a display system for suspending visuals for exhibit, training or advertising according to the present invention.

The ceiling interface member 40, as shown separately in FIG. 10A, includes a horizontal elongated support member 68 with two hooks 64 and 66 extending upward from its topside and two loops 42 and 44 extending downward from its underside. The two hooks 64 and 66 are configured and dimensioned to hook onto a television studio lighting grid.

The cords 20 and 22 are constructed of bundled elastic strands generically known as bungee cord and are commercially available.

Figure 7:
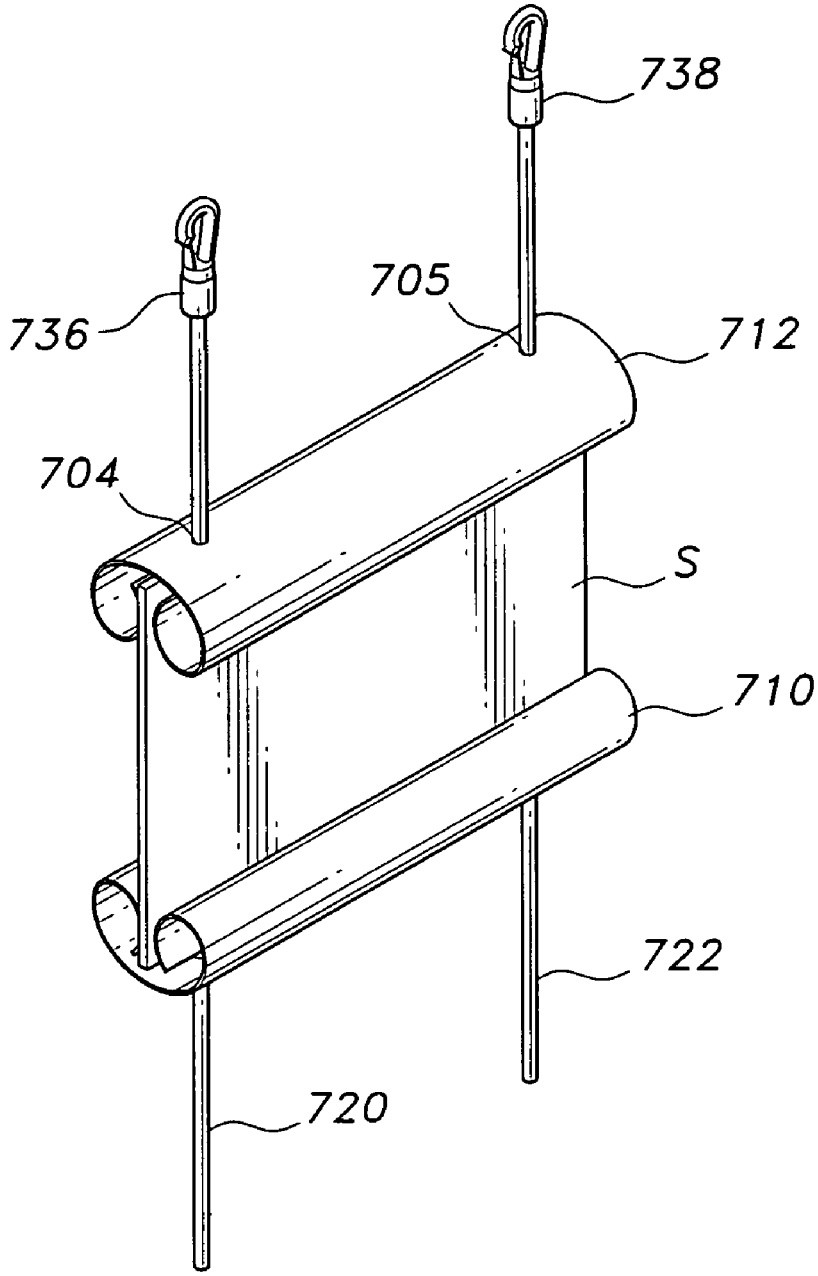
FIG. 7 is a perspective view of a portion of a display system for suspending visuals for exhibit, training or advertising according to the present invention shown with tubular members constructed of hard plastic.
Figure 8A:
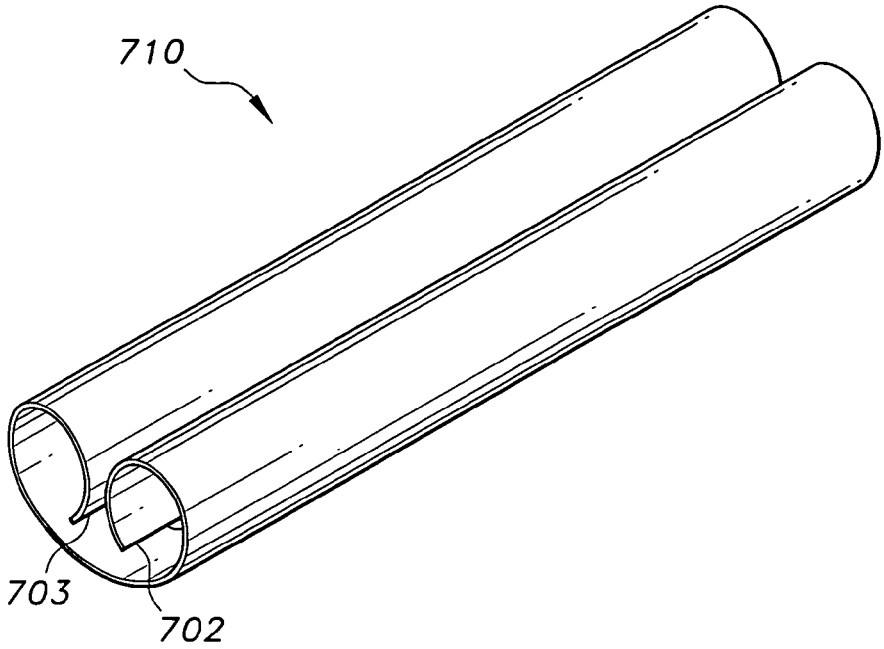
FIG. 8A is a perspective view of a tubular member constructed of hard plastic for a display system for suspending visuals for exhibit, training or advertising according to the present invention.
Figure 8B:
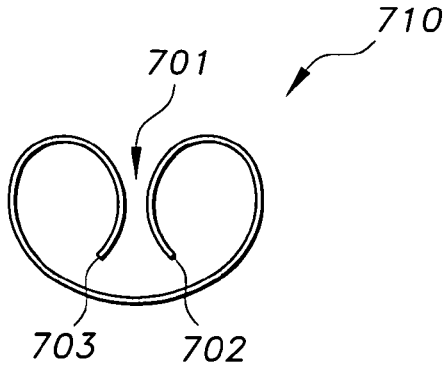
FIG. 8B is an end view of a tubular member constructed of hard plastic for a display system for suspending visuals for exhibit, training or advertising according to the present invention.

Each of the slotted tubular members 24 and 26, is a pool toy generically known as a pool noodle with a slot 56 and 58 and two holes 60 and 62 cut into each of the pool noodles. Such pool noodles are commercially available from pool equipment businesses. FIGS. 7, 8A and 8B illustrate an alternative embodiment of the slotted tubular members 710 and 712 that is constructed of a rectangular sheet of hard plastic 710 formed into a slotted tube by rolling two edges 702 and 703 of the sheet 710 inward toward one side of the sheet 710. The slot 701 is formed by a space left between the two edges 702 and 703. This alternative embodiment 710 is commercially available from a business entity doing business as Custom Plastics, Inc.

The two cord lock members 28 and 30, are constructed of hard plastic and are commercially available.

The two floor anchor members 32 and 34, are constructed of a molded metal. Other heavy objects or weights can also serve as floor anchor members.

Figure 9B:
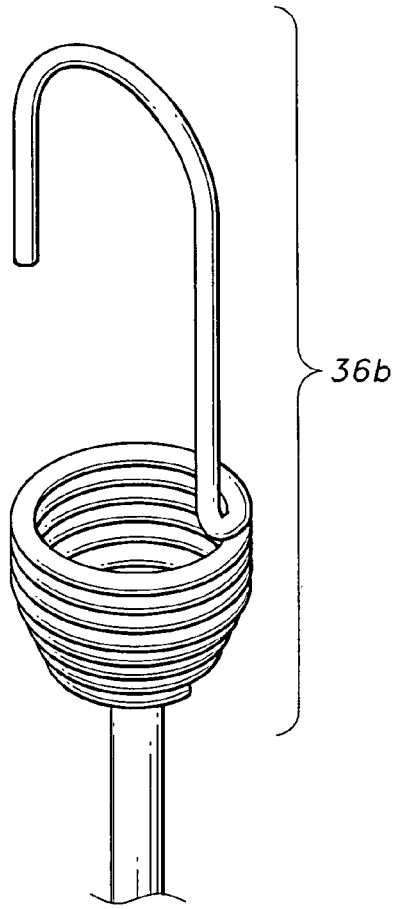
Figure 9D:
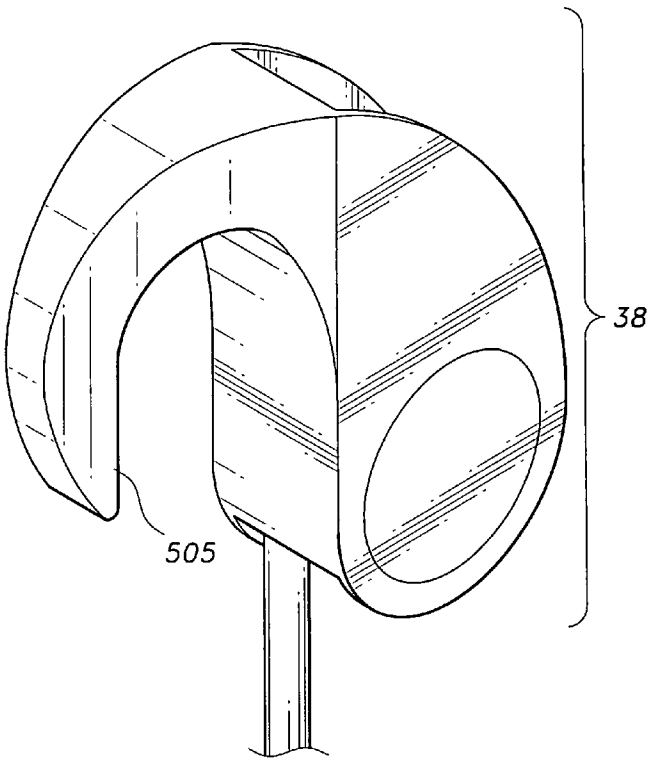
Figure 9C:
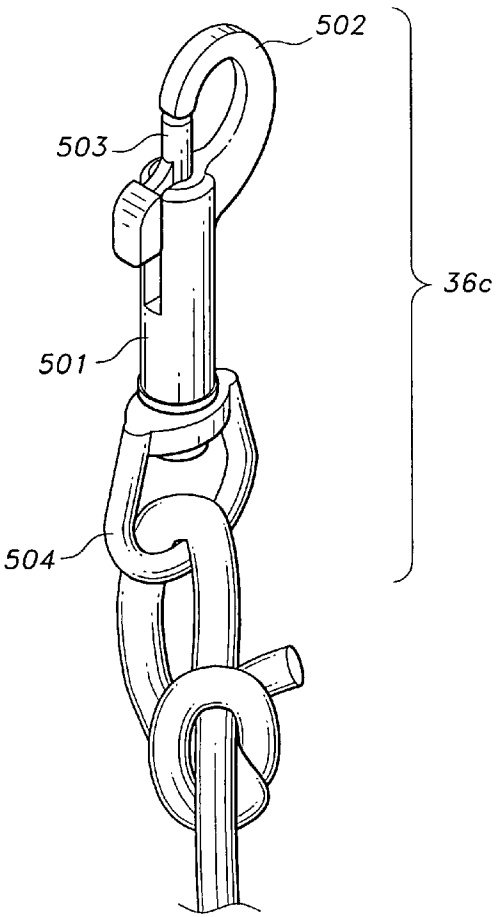

The upper cord hook members 36 are constructed of hard plastic, each with a hook member 76 and a clip member 78, and are commercially available, for example, as product number RS252-H from a business entity doing business as Reef Scuba Accessories, Inc. Other commercially available cord hook members, such as those shown in FIGS. 9B–9D, can also be used to secure the cords 20 and 22 to the ceiling interface member 40. FIG. 9B shows a cord hook member 36*b* that is constructed of rubber-coated steel and is commercially available, for example, as product number RS250-SH from the aforementioned business entity doing business as Reef Scuba Accessories, Inc. FIG. 9C shows a cord hook member 36*c* constructed of metal with a shaft 501 having a hook 502 and slideable clip 503 extending from one end and a loop 504 attached to the other end.

The lower cord hook members 38 (FIG. 9D) are constructed of plastic and are each configured with a hook extending from a main body. The main body of each cord hook member is configured with both an opening through which a cord can be passed and a locking mechanism that allows for quick and easy adjustment of the cord length. The lower cord hook members 38 are commercially available from a business entity doing business as Sta-Put, Inc., 4041 S.W. 47 Avenue, Fort Lauderdale, Fla. 33314, and are described in U.S. Pat. No. 4,340,998.

Figure 10B:
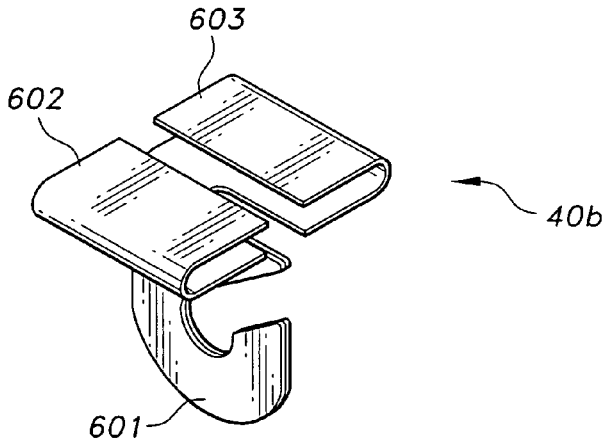
Figure 10C:
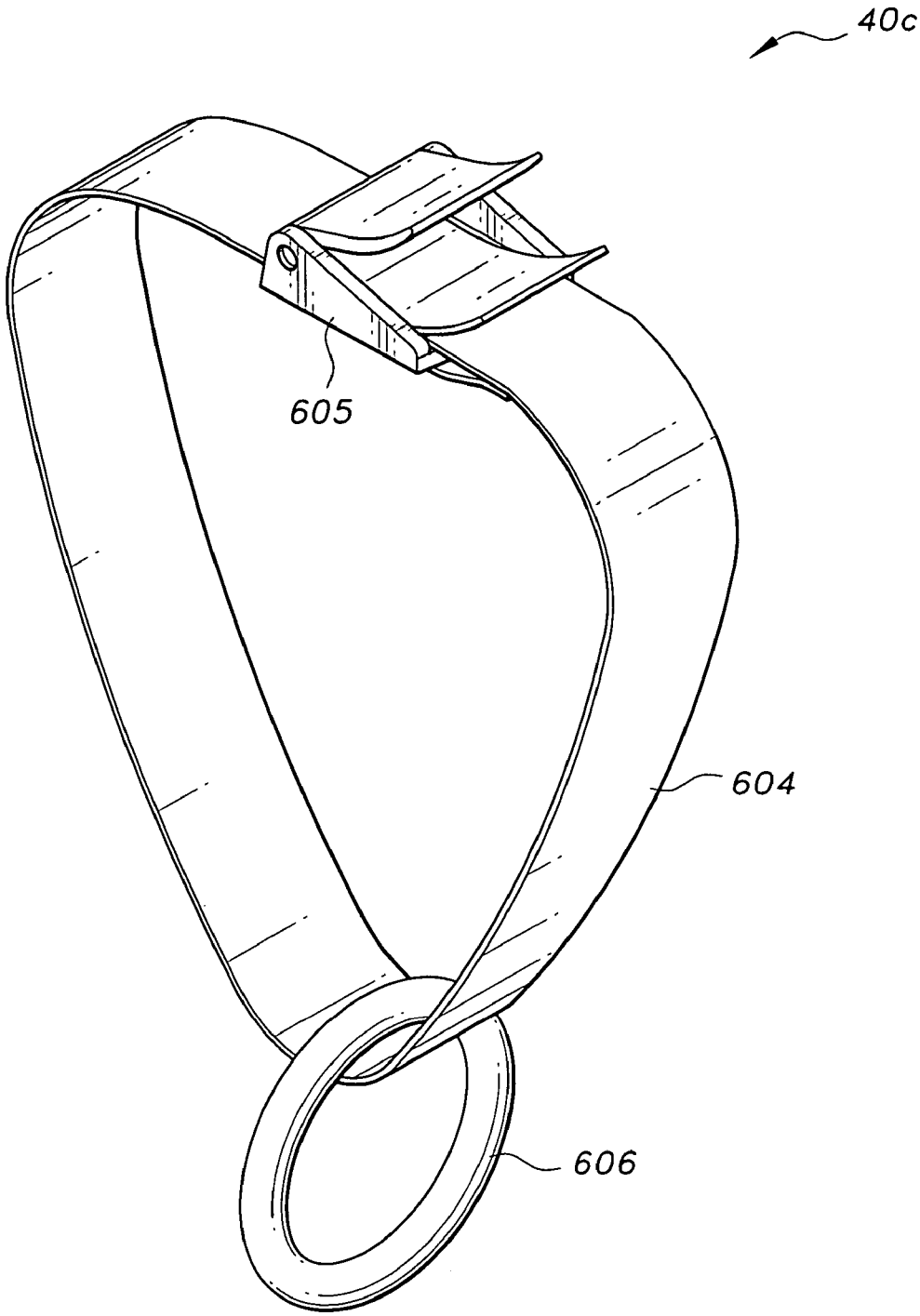

The ceiling interface member 40 is an assembly of two metal hooks 64 and 66, two metal loops 42 and 44 and an elongated piece of wood 68, all of which are commercially available. FIGS. 10B and 10C illustrate alternative ceiling interface members. FIG. 10B shows a ceiling interface member 40*b* constructed of metal that is shaped and configured to attach to a support beam for an elevated tile ceiling. It 40*b* includes a hook 601 with two folded flanges 602 and 603 that each form an opening for a portion of the elevated tile ceiling support beam. FIG. 10C shows a ceiling interface member 40*c* that includes a strap 604 and buckle 605 with a metal loop 606 and is useful with a studio lighting grid. For both of these embodiments 40*b* and 40*c*, two units would be used—one for each cord 20 and 22.

Figure 4:
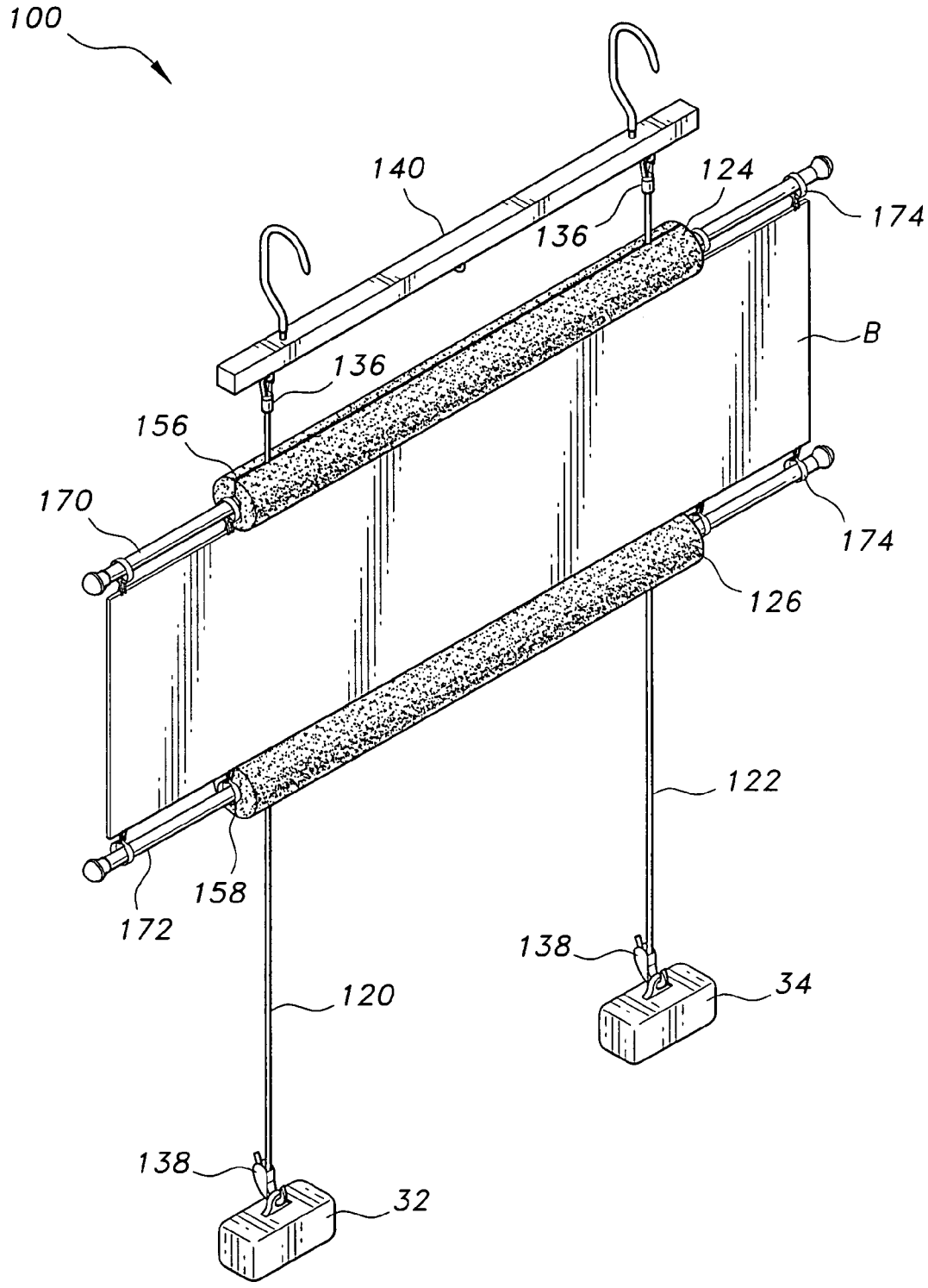
FIG. 4 is a perspective view of an alternative embodiment of a display system for suspending visuals for exhibit, training or advertising according to the present invention shown displaying a banner.
Figure 5:
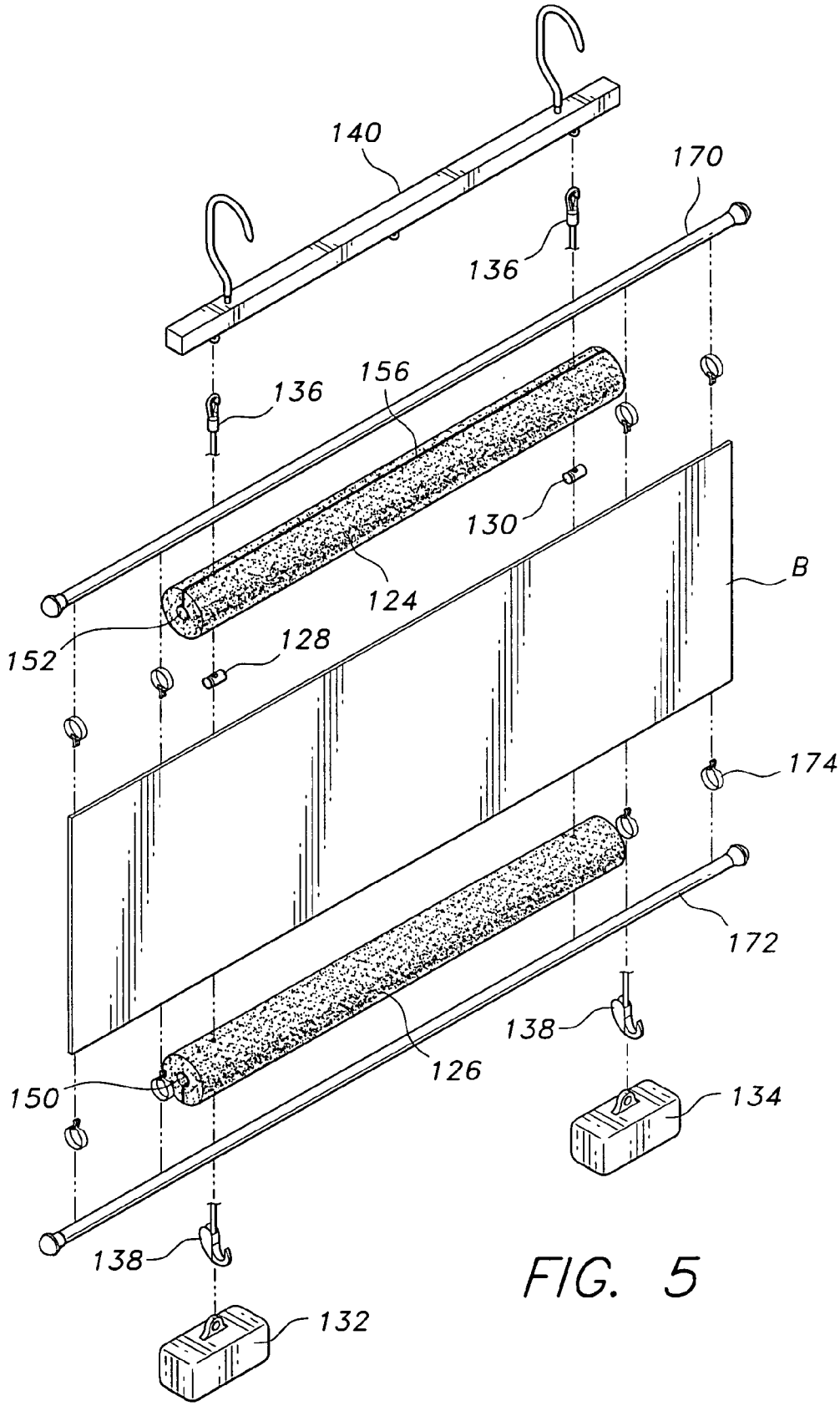
FIG. 5 is an exploded view of the mounted banner shown in FIG. 4.

FIGS. 4 and 5 illustrate an alternative embodiment 100 that is configured to display a banner. Like the embodiment 10 discussed above, this embodiment 100 includes two elastic cords 120 and 122, two rod supporting tubular members 124 and 126, two cord lock members 128 and 130, two floor anchor members 132 and 134, four cord hook members 136 and 138, and a ceiling interface member 140 which are identical to those described above. This embodiment 100 also includes two elongated rods 170 and 172 and a plurality of banner clips 174.

In this embodiment 100, the tubular members 124 and 126 are oriented differently in order to support the elongated rods 170 and 172. The upper tubular member 124 is oriented with its apertures below its slot 156, and rests on top of the cord lock members 128 and 130 thereby being held in position on the cords 120 and 122 by the cord lock members 128 and 130. The lower tubular member 126 is oriented with its apertures above its slot 158.

An elongated rod 170 and 172 passes through the cavity 150 and 152 in each of the tubular members 124 and 126. Each rod 170 and 172 is longer than its corresponding tubular member 124 and 126 and therefore portions of each rod 170 and 172 extend beyond each of the ends of each corresponding tubular member 124 and 126. Banner clips 174 hanging from the portions of the upper elongated rod 170 extending out of the upper tubular member 124 are clipped to the top edge of a banner B, thereby supporting the banner B. Banner clips 174 secured to the lower elongated rod 172 are clipped to the bottom edge of banner B.

Figure 6:
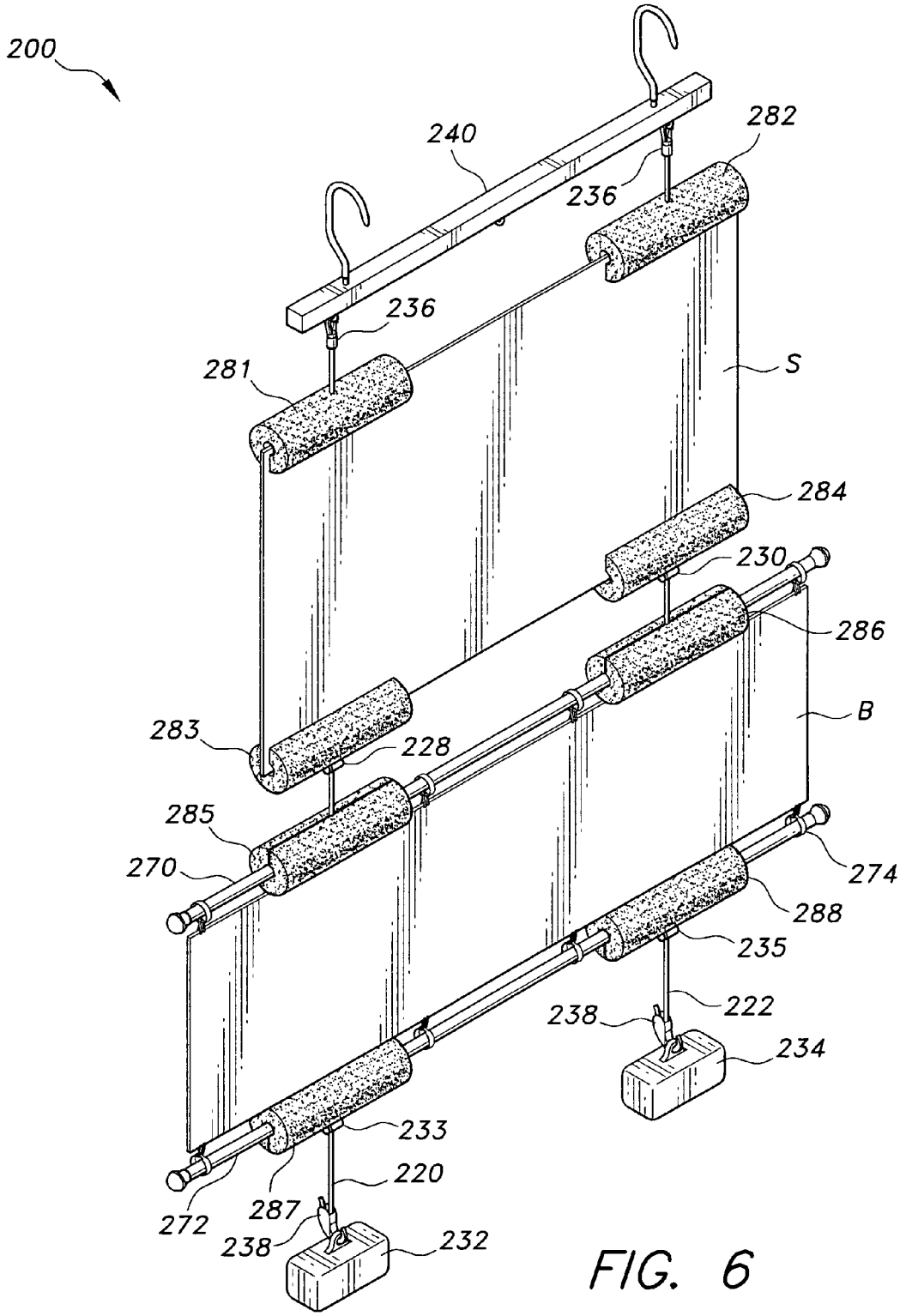
FIG. 6 is a perspective view of a second alternative embodiment of a display system for suspending visuals for exhibit, training or advertising according to the present invention shown displaying a banner and a sign mounted to foam board.

FIG. 6 illustrates a second alternative embodiment 200 that is configured to display both a banner and a rigid sign, with the sign S positioned above the banner B. Essentially, this embodiment 200 is a combination of the two embodiments 10 and 100 described above. The one notable difference being that this embodiment 200, has four tubular members—two upper tubular members and two lower tubular members—supporting each displayed article S and B, for a total of eight tubular members 281–288. Four of the eight tubular members 281–288 are tubular members 281, 282, 283 and 284 supporting sign S, and four of eight tubular members 281–288 are rod supporting tubular members 285, 286, 287 and 288 supporting elongated rods 270 and 272. Thus, this embodiment includes two elastic cords 220 and 222, eight tubular members 281–288, four cord lock members 228, 230, 233 and 235, two elongated rods 270 and 272, two floor anchor members 232 and 234, four cord hook members 236 and 238, a plurality of banner clips 274, and a ceiling interface member 240.

By having two upper and two lower tubular members 281–288 for each displayed article S and B, the tubular members 281–288 can be smaller in length and therefore more easily stored and transported.

Figure 1:
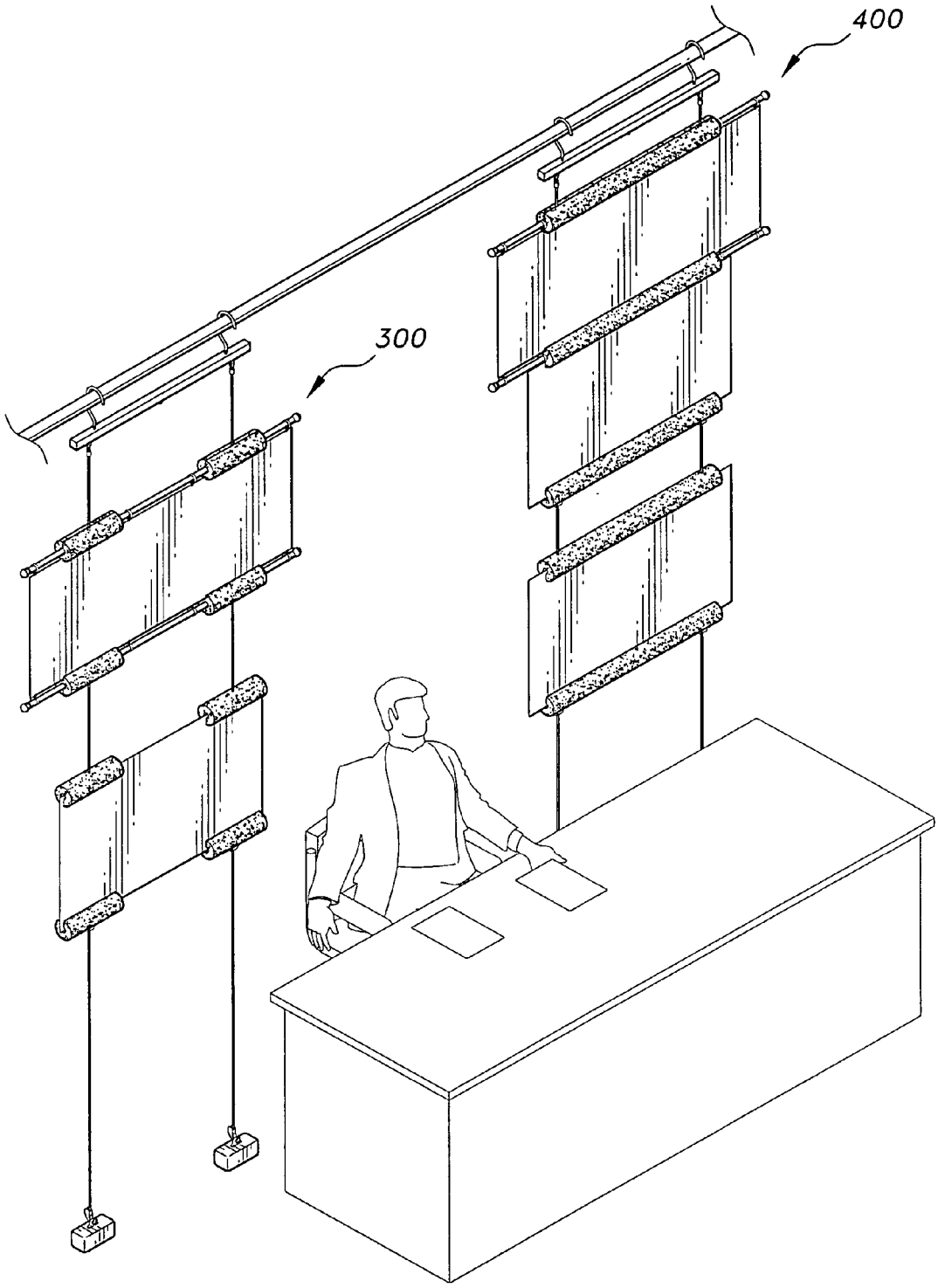
FIG. 1 is an environmental, perspective view of two embodiments of a display system for suspending visuals for exhibit, training or advertising according to the present invention as used on the set of a local television station.

FIG. 1. illustrates a third and fourth alternative embodiment 300 and 400 of the invention shown in use on the set of a local television station. The third alternative embodiment 300 is nearly identical to the second alternative embodiment 200. The difference being that the banner is displayed above the sign on the third alternative 300, whereas with the second alternative 200 the banner is displayed below the sign.

The fourth alternative embodiment 400 is configured to display a banner and two separate signs. In this embodiment 400, the banner is positioned above the signs, and the lower tubular member for the banner also acts as the upper tubular member for the upper sign.

In all possible embodiments of the invention, each set of slotted tubular members can be used to display two signs. To do so, a first sign would be suspended facing forward and a second sign would be suspended behind the first sign and facing backward such that the first sign is viewed from the front of the invention and the second sign is view from the back of the invention. Likewise, each set of elongated rods with supporting tubular members can be used to display two banners. To do so, a first banner would be suspended facing forward and a second banner would be suspended behind the first banner and facing backward such that the first banner is viewed from the front of the invention and the second banner is view from the back of the invention.

It is to be understood that the present invention is not limited to the embodiments described above, but encompasses any and all embodiments within the scope of the following claims.

I claim:

1. A display system for suspending visuals for exhibit, training or advertising, comprising in combination:

a first and second cord, each of said cords having a first end and a second end;

an upper tubular member being substantially cylindrical in shape and having a first end, a second end, a first aperture, a second aperture and a slot extending from said first end to said second end;

a lower tubular member being substantially cylindrical in shape and having a first end, a second end, a first aperture, a second aperture and a slot extending from said first end to said second end;

a first and second cord lock member;

a first and second upper cord hook member;

a first and second lower cord hook member;

a first and second floor anchor member;

wherein said first end of said first cord is secured to said first lower cord hook member with said first lower cord hook member being hooked to said first floor anchor member and said second end of said first cord is secured to said first upper cord hook member; said first cord extending up from said first floor anchor member through said first cord lock member, through said first aperture in said lower tubular member, through said first aperture in said upper tubular member, and to said first upper cord hook member; and wherein said first end of said second cord is secured to said second lower cord hook member with said second lower cord hook member being hooked to said second floor anchor member and said second end of said second cord is secured to said second upper cord hook member; said second cord extending up from said second floor anchor member through said second cord lock member, through said second aperture in said lower tubular member, through said second aperture in said upper tubular member, and to said second upper cord hook member;

whereby, when a flat substantially rigid and substantially rectangular display article is situated with its bottom edge positioned in said slot in said lower tubular member and its top edge positioned in said slot in said upper tubular member, the display article is suspended for viewing.

2. The display system for suspending visuals for exhibit, training or advertising according to claim 1, further comprising:

a ceiling interface member having an elongated member disposed horizontally, two grid hooks extending upward from said elongated member, and a first and second loop extending downward from said elongated member;

wherein each of said grid hooks is configured and dimensioned to hook onto a light grid and each of said loops is configured and dimensioned to support attachment thereto by one of said upper cord hook members;

whereby, when said grid hooks are hooked onto a light grid and when said first upper cord hook member is attached to said first loop and said second upper cord hook member is attached to said second loop, the display article is suspended for viewing.

3. The display system for suspending visuals for exhibit, training or advertising according to claim 1, further comprising:

at least one additional upper tubular member; each of said additional upper tubular members being substantially cylindrical in shape and having a first end, a second end, a first aperture, a second aperture and a slot extending from said first end to said second end;

at least one additional lower tubular member; each of said additional lower tubular members being substantially cylindrical in shape and having a first end, a second end, a first aperture, a second aperture and a slot extending from said first end to said second end; and at least two additional cord lock members;

wherein said first cord passes through said first aperture in each of said additional upper tubular members and through said first aperture in each of said additional lower tubular members, and one of said additional cord lock members is positioned below each additional lower tubular member on said first cord;

wherein said second cord passes through said second aperture in each of said additional upper tubular members and through said second aperture in each of said additional lower tubular members, and one of said additional cord lock members is positioned below each additional lower tubular member on said second cord;

whereby, for each pair of an additional upper tubular member and an additional lower tubular member, when an additional flat substantially rigid and substantially rectangular display article is situated with its bottom edge positioned in said slot in said additional lower tubular member and its top edge positioned in said slot in said additional upper tubular member, the additional display article is suspended for viewing.

4. The display system for suspending visuals for exhibit, training or advertising according to claim 1, further comprising:

an upper rod-supporting tubular member being substantially cylindrical in shape and having a first end, a second end, a first aperture, a second aperture and an elongated cavity extending from said first end to said second end;

an upper rod passing through said elongated cavity in said upper rod-supporting tubular member; said rod being longer than said upper rod-supporting tubular member and portions of said rod extending outside of said first and second ends of said upper rod-supporting tubular member;

a lower rod-supporting tubular member being substantially cylindrical in shape and having a first end, a second end, a first aperture, a second aperture and an elongated cavity extending from said first end to said second end;

a lower rod passing through said elongated cavity in said lower rod-supporting tubular member; said rod being longer than said lower rod-supporting tubular member and portions of said rod extending outside of said first and second ends of said lower rod-supporting tubular member;

a plurality of banner clips shaped and configured to secure a banner to said upper and lower rods; and two additional cord lock members;

wherein said first cord passes through said first aperture in said upper rod-supporting tubular member and through said first aperture in said lower rod-supporting tubular member, and one of said additional cord lock members is positioned on said first cord below said upper rod-supporting tubular member; and wherein said second cord passes through said second aperture in said upper rod-supporting tubular member and through said second aperture in said lower rod-supporting tubular member, and one of said additional cord lock members is positioned on said second cord below said upper rod-supporting tubular member;

whereby, when a banner is situated with its top edge secured to said upper rod by a plurality of said banner clips and its bottom edge secured to said lower rod by a plurality of said banner clips, the banner is suspended for viewing.

5. A display system for suspending visuals for exhibit, training or advertising, comprising in combination:

a first and second cord, each of said cords having a first end and a second end;

an upper rod-supporting tubular member being substantially cylindrical in shape and having a first end, a second end, a first aperture, a second aperture and an elongated cavity extending from said first end to said second end;

an upper rod passing through said elongated cavity in said upper rod-supporting tubular member; said rod being longer than said upper rod-supporting tubular member and portions of said rod extending outside of said first and second ends of said upper rod-supporting tubular member;

a lower rod-supporting tubular member being substantially cylindrical in shape and having a first end, a second end, a first aperture, a second aperture and an elongated cavity extending from said first end to said second end;

a lower rod passing through said elongated cavity in said lower rod-supporting tubular member; said rod being longer than said lower rod-supporting tubular member and portions of said rod extending outside of said first and second ends of said lower rod-supporting tubular member;

a plurality of banner clips shaped and configured to secure a banner to said upper and lower rods;

a first and second cord lock member;

a first and second upper cord hook member;

a first and second lower cord hook member;

a first and second floor anchor member;

wherein said first end of said first cord is secured to said first lower cord hook member with said first lower cord hook member being hooked to said first floor anchor member and said second end of said first cord is secured to said first upper cord hook member; said first cord extending up from said first floor anchor member through said first aperture in said lower rod-supporting tubular member, through said first cord lock member, through said first aperture in said upper rod-supporting tubular member, and to said first upper cord hook member; and wherein said first end of said second cord is secured to said second lower cord hook member with said second lower cord hook member being hooked to said second floor anchor member and said second end of said second cord is secured to said second upper cord hook member; said second cord extending up from said second floor anchor member through said second aperture in said lower rod-supporting tubular member, through said second cord lock member, through said second aperture in said upper rod-supporting tubular member, and to said second upper cord hook member; and whereby, when a banner is situated with its top edge secured to said upper rod by a plurality of said banner clips and its bottom edge secured to said lower rod by a plurality of said banner clips, the banner is suspended for viewing.

6. The display system for suspending visuals for exhibit, training or advertising according to claim 5, further comprising:

a ceiling interface member having an elongated member disposed horizontally, two grid hooks extending upward from said elongated member, and a first and second loop extending downward from said elongated member;

wherein each of said grid hooks is configured and dimensioned to hook onto a light grid and each of said loops is configured and dimensioned to support attachment thereto by one of said upper cord hook members;

whereby, when said grid hooks are hooked onto a light grid and when said first upper cord hook member is attached to said first loop and said second upper cord hook member is attached to said second loop, the banner is suspended for viewing.

7. The display system for suspending visuals for exhibit, training or advertising according to claim 5, further comprising:

at least one additional upper rod-supporting tubular member; each of said additional upper rod-supporting tubular members being substantially cylindrical in shape and having a first end, a second end, a first aperture, a second aperture and an elongated cavity extending from said first end to said second end;

an upper rod passing through said elongated cavity in each of said additional upper rod-supporting tubular members; said rod being longer than said additional upper rod-supporting tubular member and portions of said rod extending outside of said first and second ends of said additional upper rod-supporting tubular member;

at least one additional lower rod-supporting tubular member; each of said additional lower rod-supporting tubular members being substantially cylindrical in shape and having a first end, a second end, a first aperture, a second aperture and an elongated cavity extending from said first end to said second end;

a lower rod passing through said elongated cavity in each of said additional lower rod-supporting tubular members; said rod being longer than said additional lower rod-supporting tubular member and portions of said rod extending outside of said first and second ends of said additional lower rod-supporting tubular member;

at least two additional cord lock members;

wherein said first cord passes through said first aperture in each of said additional upper rod-supporting tubular members and through said first aperture in each of said additional lower rod-supporting tubular members, and one of said additional cord lock members is positioned below each additional upper rod-supporting tubular member on said first cord; and wherein said second cord passes through said second aperture in each of said additional upper rod-supporting tubular members and through said second aperture in each of said additional lower rod-supporting tubular members, and one of said additional cord lock members is positioned below each additional upper rod-supporting tubular member on said second cord;

whereby, for each pair of an additional upper rod-supporting tubular member and an additional lower rod-supporting tubular member, when an additional banner is situated with its top edge secured to said upper rod of said additional upper rod-supporting tubular member by a plurality of said banner clips and its bottom edge secured to said lower rod of said additional lower rod-supporting member by a plurality of said banner clips, the additional banner is suspended for viewing.

8. The display system for suspending visuals for exhibit, training or advertising according to claim 5, further comprising:

an upper tubular member being substantially cylindrical in shape and having a first end, a second end, a first aperture, a second aperture and a slot extending from said first end to said second end;

a lower tubular member being substantially cylindrical in shape and having a first end, a second end, a first aperture, a second aperture and a slot extending from said first end to said second end; and two additional cord lock members;

wherein said first cord passes through said first aperture in said upper tubular member and through said first aperture in said lower tubular member, and one of said additional cord lock members is positioned on said first cord below said lower tubular member;

wherein said second cord passes through said second aperture in said upper tubular member and through said second aperture in said lower tubular member, and one of said additional cord lock members is positioned on said second cord below said lower tubular member;

whereby, when a flat substantially rigid and substantially rectangular display article is situated with its bottom edge positioned in said slot in said lower tubular member and its top edge positioned in said slot in said upper tubular member, the display article is suspended for viewing.

9. A display system for suspending visuals for exhibit, training or advertising, comprising in combination:

a first and second cord, each of said cords having a first end and a second end;

a first and second upper tubular member; each of said upper tubular members being substantially cylindrical in shape and having a first end, a second end and an aperture;

a first and second lower tubular member; each of said lower tubular members being substantially cylindrical in shape and having a first end, a second end and an aperture;

a first and second cord lock member;

a first and second upper cord hook member;

a first and second lower cord hook member;

a first and second floor anchor member; and means for securing an edge of a display article to a tubular member;

wherein said first end of said first cord is secured to said first lower cord hook member with said first lower cord hook member being hooked to said first floor anchor member and said second end of said first cord is secured to said first upper cord hook member; said first cord passing through said first cord lock member, through said aperture in said first lower tubular member, and through said aperture in said first upper tubular member; and wherein said first end of said second cord is secured to said second lower cord hook member with said second lower cord hook member being hooked to said second floor anchor member and said second end of said second cord is secured to said second upper cord hook member; said second cord passing through said second cord lock member, through said aperture in said second lower tubular member, and through said aperture in said second upper tubular member;

whereby, when said first and second upper tubular members are secured to the top edge of a flat substantially rectangular display article by said means for securing an edge of a display article to a tubular member, and said first and second lower tubular members are secured to the bottom edge of the display article by said means for securing an edge of a display article to a tubular member, the display article is suspended for viewing.

10. The display system for suspending visuals for exhibit, training or advertising according to claim 9, wherein:

said means for securing an edge of a display article to a tubular member is a slot in each of said upper and lower tubular members;

said slot extending from said first end to said second end of each of said upper and lower tubular members;

whereby, when said first and second upper tubular members are secured to the top edge of a flat substantially rigid and substantially rectangular display article by positioning a portion of the top edge of the display article in said slot in said first and second upper tubular members, and said first and second lower tubular members are secured to the bottom edge of the display article by positioning a portion of the bottom edge of the display article in said slot in said first and second lower tubular members, the display article is suspended for viewing.

11. The display system for suspending visuals for exhibit, training or advertising according to claim 9, wherein:

each of said first and second upper tubular members and said first and second lower tubular members has an elongated cavity extending from said first end to said second end; and said means for securing an edge of a display article to a tubular member is an upper and lower elongated rod and a plurality of banner clips; said upper elongated rod passing through said cavity in each of said first and second upper tubular members, and said lower elongated rod passing through said cavity in each of said first and second lower tubular members;

whereby, when a banner is situated with its top edge secured to said upper rod by a plurality of said banner clips and its bottom edge secured to said lower rod by a plurality of said banner clips, the banner is suspended for viewing.

12. The display system for suspending visuals for exhibit, training or advertising according to claim 9, further comprising:

a ceiling interface member having an elongated member disposed horizontally, two grid hooks extending upward from said elongated member, and a first and second loop extending downward from said elongated member;

wherein each of said grid hooks is configured and dimensioned to hook onto a light grid and each of said loops is configured and dimensioned to support attachment thereto by one of said upper cord hook members;

whereby, when said grid hooks are hooked onto a light grid and when said first upper cord hook member is attached to said first loop and said second upper cord hook member is attached to said second loop, the display article is suspended for viewing.

13. The display system for suspending visuals for exhibit, training or advertising according to claim 9, further comprising:

at least one pair of additional upper tubular members; each of said additional upper tubular members being substantially cylindrical in shape and having a first end, a second end and an aperture;

at least one pair of additional lower tubular members; each of said additional lower tubular members being substantially cylindrical in shape and having a first end, a second end and an aperture; and at least two additional cord lock members;

wherein said first cord passes through said aperture in one of said additional upper tubular members for each pair of said additional upper tubular members, through said aperture in one of said additional lower tubular members for each pair of said additional lower tubular members, and through one of said additional cord lock members for each pair of additional cord lock members;

wherein said second cord passes through said aperture in one of said additional upper tubular members for each pair of additional upper tubular members, through said aperture in one of said additional lower tubular members for each pair of additional lower tubular members, and through one of said additional cord lock members for each pair of additional cord lock members;

whereby, for each set of a pair of additional upper tubular member and a pair of additional lower tubular member, when said first and second upper tubular members are secured to the top edge of a flat substantially rectangular display article by said means for securing an edge of a display article to a tubular member, and said first and second lower tubular members are secured to the bottom edge of the display article by said means for securing an edge of a display article to a tubular member, the display article is suspended for viewing.

* * * * *